United States Patent [19]

Dicker

[11] 4,384,670

[45] May 24, 1983

[54] PEEL BACK MAILER

[75] Inventor: David Dicker, Scarsdale, N.Y.

[73] Assignee: Transkrit Corporation, Elmsford, N.Y.

[21] Appl. No.: 234,727

[22] Filed: Feb. 17, 1981

[51] Int. Cl.[3] ..... B65D 27/10

[52] U.S. Cl. ..... 229/69; 229/73

[58] Field of Search ..... 229/69, 73

[56] References Cited

U.S. PATENT DOCUMENTS

| | | | |
|---|---|---|---|
| Re. 30114 | 10/1979 | Juszak et al. | 229/69 |
| 3,419,286 | 12/1968 | Noonan et al. | 229/69 |
| 3,428,237 | 2/1969 | Dowen | 229/69 |
| 3,942,714 | 3/1976 | Wise | 229/73 |
| 4,012,268 | 3/1977 | Johnson | 229/69 |
| 4,055,294 | 10/1977 | Traise | 229/73 |
| 4,157,759 | 6/1979 | Dicker | 229/73 |
| 4,180,168 | 12/1979 | Hiersteiner | 229/73 |
| 4,277,016 | 7/1981 | Wakeman et al. | 229/69 |

FOREIGN PATENT DOCUMENTS

| | | | |
|---|---|---|---|
| 591022 | 1/1960 | Canada | 229/73 |

*Primary Examiner*—Joseph Man-Fu Moy
*Assistant Examiner*—Gary E. Elkins
*Attorney, Agent, or Firm*—Kenyon & Kenyon

[57] ABSTRACT

The peel-back mailer has a front ply which can be peeled off to expose inserts and a return mail envelope. In addition, a tab portion on an intermediate ply is secured to the front ply so as to be simultaneously removed during peeling off of the front ply. The exposed flap on the back ply is foldable to seal the return envelope and carries adhesive for this purpose.

13 Claims, 7 Drawing Figures

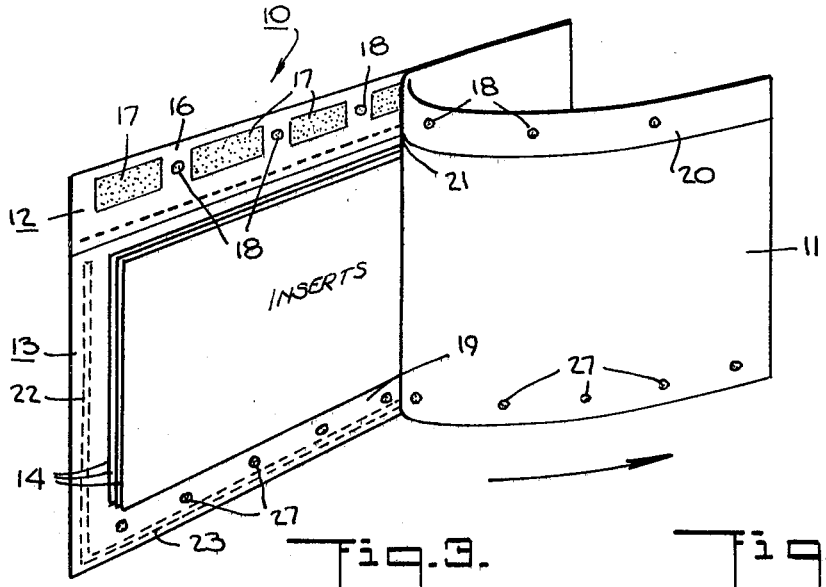
Fig. 3.
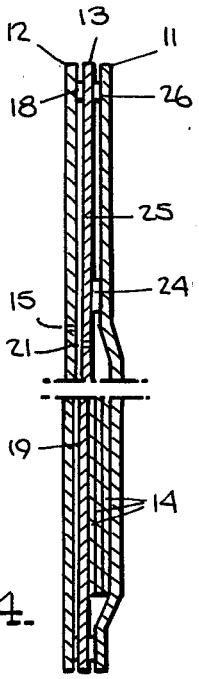
Fig. 4.
Fig. 6.
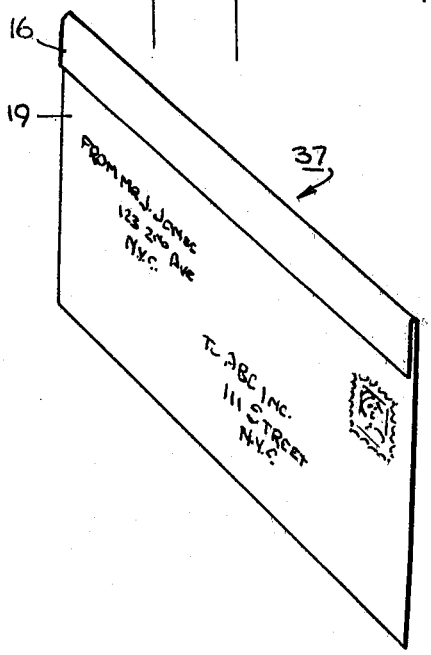
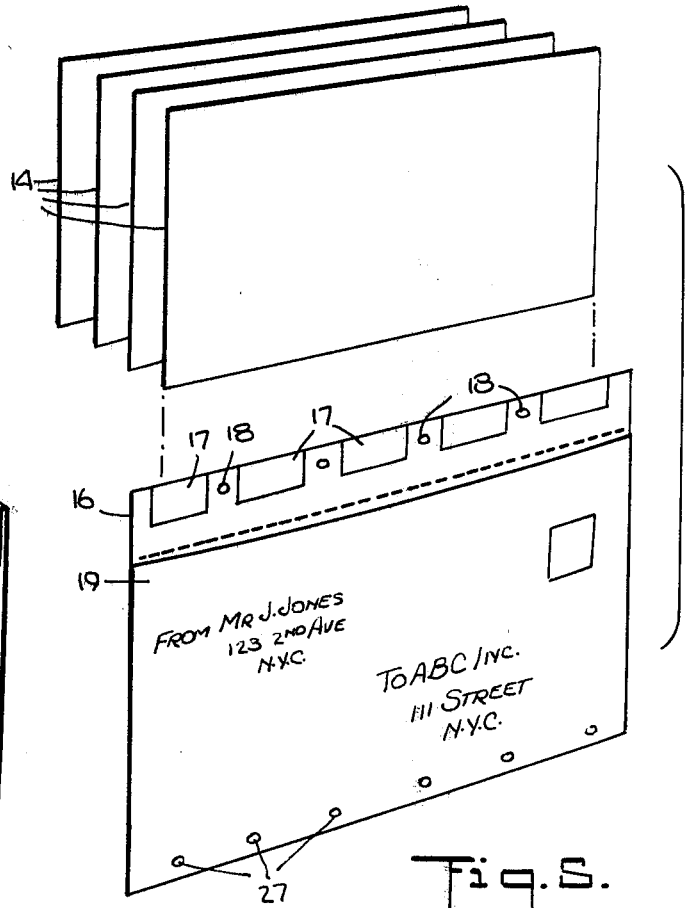
Fig. 5.

PEEL BACK MAILER

This invention relates to a peel back mailer. More particularly, this invention relates to a continuous mailer assembly. Still more particularly, this invention relates to a mailer which incorporates a return mail envelope therein.

Heretofore, various types of continuous mailer assemblies have been known which provide a series of envelopes which can be mailed and which incorporate return mail envelopes therein for return mail purposes. Generally, these continuous mailer assemblies have been made of multi-ply construction with the various plies forming the front and back ply of a mailer while the same or other plies form a return mail envelope. In one particular case, it has been known to secure an intermediate ply to a back ply to form a return mail envelope and to provide the intermediate ply with a tear-off flap to permit a flap on the back ply to be folded over the remainder of the intermediate ply to seal the return mail envelope. In this case, the front ply of the envelope is removed in order to expose the intermediate ply so that the tear-off flap can be removed. The remaining insert plies can then be processed in various manners with at least one of the insert plies being inserted into the return mail envelope. Thereafter, the upper edge of the back ply can be folded over to seal the return mail envelope.

Such envelopes, however, require manual removal of the tear-off flap of the intermediate ply in order to obtain a return mail envelope. In some cases, removal of the tear-off flap has been cumbersome and, in other cases, removal of the tear-off flap may damage the remainder of the insert ply to such an extent that the return mail envelope may not be useable.

Accordingly, it is an object of the invention to provide a mailer of a construction wherein a return mail envelope incorporated therein is readily accessable.

It is another object of the invention to provide a continuous mailer assembly of mailers which incorporate return mail envelopes therein in a simple manner.

It is another object of the invention to remove a flap of a return mail envelope of a continuous mailer assembly in a relatively easy and efficient manner.

Briefly, the invention provides a mailer which is comprised of a front ply for receiving information thereon, a back ply of a size equal to the front ply and including a flap portion having adhesive means thereon facing the front ply and an intermediate ply between the front and back plies. This intermediate ply includes a body portion and a tab portion which is removably secured to the body portion. In addition, the body portion is secured to the back ply to define a pocket therewith while the tab portion is secured to the front ply for removal therewith. Further, the mailer has means releaseably securing the front ply to the body portion of the intermediate ply.

The mailer may also include at least one insert ply between the body portion of the intermediate ply and the front ply. In such a case, the insert ply is of a size smaller than the body portion in order to permit the front ply to be releaseably secured to the body portion of the intermediate ply as well as to be able to fit within the pocket formed between the back ply and the intermediate ply.

Any suitable means may be used to releaseably secure the body portion of the intermediate ply to the first ply.

For example, the means may be in the form of a plurality of spaced apart glue spots between the body portion and front ply.

In addition, the mailer has a removable stub on each ply along each of two opposite edges. These stubs are secured to each other in overlying relation, for example by adhesive means, for coincident removal.

The invention also provides a continuous mailer assembly which is composed of a plurality of mailers constructed in the above manner. Specifically, the continuous mailer assembly is comprised of three continuous webs which are disposed in overlying relation as well as various non-continuous webs between two of the continuous webs. Each of these webs has a removable strip with control line holes along each of two opposite marginal edges, a longitudinal line of weakening adjacent each marginal edge to define a removable stub and a plurality of transverse lines of weakening to sub-divide the webs into a series of individual mailers.

The continuous mailer may also have an additional longitudinal line of weakening in each of the overlying webs in order to further divide the webs into two series of individual mailers which are disposed in side-by-side relation.

In use, the continuous mailer assembly is processed through automatic equipment, such as a computer printer, via the control line holes. At this time, printed information can be applied to the face of the front ply of each mailer while additional information is applied in known fashion to the underlying intermediate ply and insert plies. Thereafter, the strips containing the control line holes can be removed and the individual mailers removed from the assembly for mailing purposes. Upon receipt of a mailer by an addressee, the stubs along the marginal edges of the mailer are removed. Next, the front ply is peeled back and removed from the mailer. At this time, since the tab portion of the intermediate ply is secured to the back of the front ply, the tab portion is also removed simultaneously. Thus, the return mail envelope formed by the body portion of the intermediate ply and the back ply is immediately ready for use. One or more of the inserts or other items can then be placed in the return mail envelope and the exposed flap on the back ply of the return mail envelope folded downwardly over the front face of the intermediate ply to seal the pocket. The closed return mail envelope can then be returned via the mail to the original sender. To this end, the address of the original sender may have been printed on the face of the intermediate ply when processed through the automatic equipment.

Alternatively, the information regarding the sender and addressee may be applied to the front face of the intermediate ply of the return mail envelope.

It is to be noted that the mailer may be oriented such that the tab portion is secured to the back ply with the back ply being peelable from the remaining plies. The remaining plies will thus form a return mail envelope as in the same manner as above.

These and other objects and advantages of the invention will become more apparent from the following detailed description taken in conjunction with the accompanying drawings wherein:

FIG. 3 illustrates a mailer constructed in accordance with the invention;

FIG. 4 illustrates a cross-sectional view of the mailer of FIG. 3;

FIG. 5 illustrates an exploded view of the return mail envelope and inserts which are incorporated in the mailer of FIG. 3;

FIG. 6 illustrates a perspective view of the return mail envelope in a closed condition.

Figure 1:
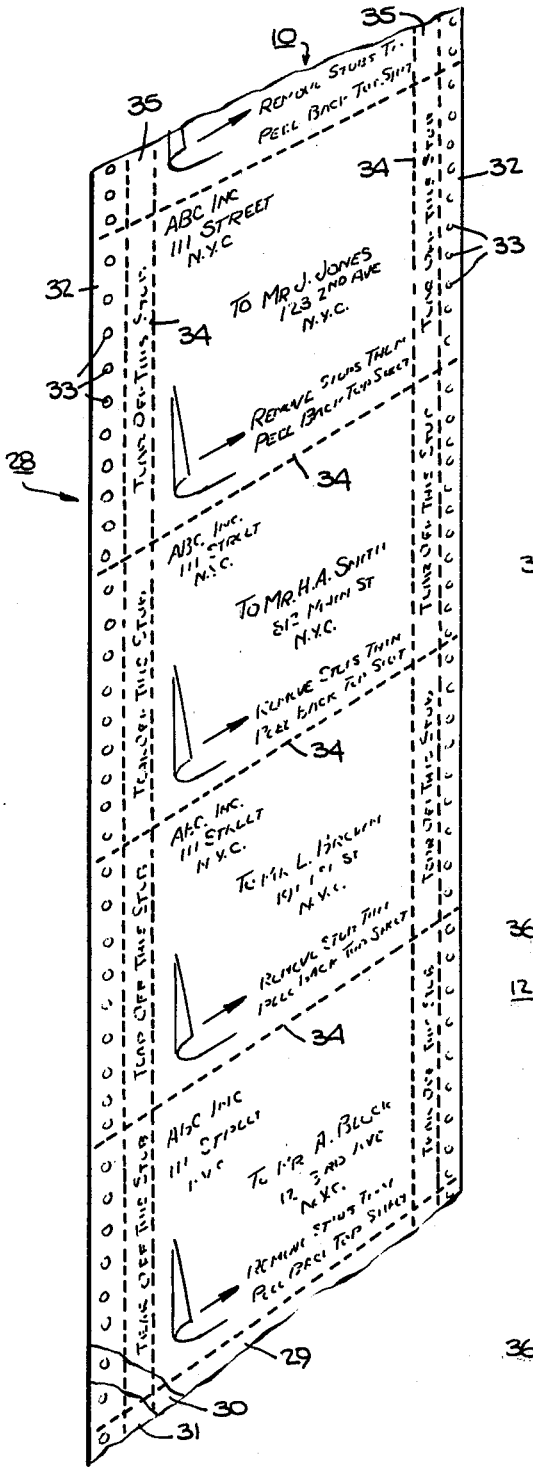
FIG. 1 illustrates a perspective view of a continuous mailer assembly constructed in accordance with the invention.

Referring to FIGS. 3 and 4, the mailer 10 includes a front ply 11, a back ply 12, an intermediate ply 13 and one or more insert plies 14.

Figure 2:
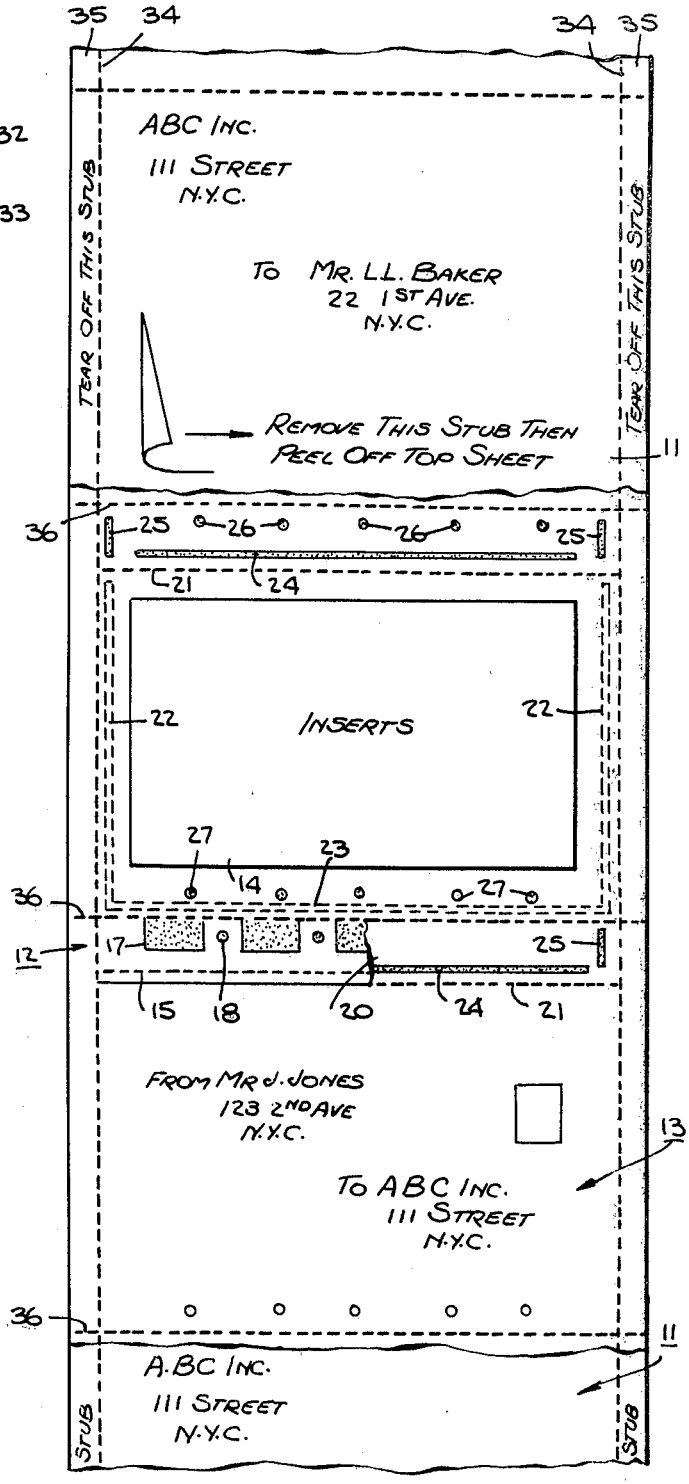
FIG. 2 illustrates a partial broken-away view of the continuous mailer assembly of FIG. 1.

The front ply 11 is of any suitable shape, such as a rectangular shape and has a front face for receiving information thereon as shown in FIG. 2.

The back ply 12 is of a size equal to the size of the front ply 11 and includes a transverse line of weakening 15 which defines a flap portion 16 extending across the width of the ply 12. The flap portion 16 has an adhesive means, for example in the form of spaced apart blocks 17 of a water-activated adhesive, facing the back of the front ply 11. In addition, a series of glue spots 18 are disposed in alternation with the adhesive blocks 17 in order to removably secure the front ply 11 to the back ply 12. It is to be noted that the blocks of adhesive 17 are secured only to the back ply 12 and are not adhesively secured to the front ply 11. To this end, the adhesive is subsequently activated for use as described below.

The intermediate ply 13 is located between the front ply 11 and back ply 12 and includes a body portion 19 and a tab portion 20 which is removably secured to the body portion 19, for example via a line of weakening or perforations 21. The body portion 19 is secured to the back ply 12 along three edges via a pair of longitudinal glue lines 22 and a transverse glue line 23 so that an open-ended pocket is formed. In a similar manner, the tab portion 20 is secured to the front ply 11 for removal therewith via a longitudinal glue line 24 and a transverse glue line 25 (see FIG. 2). Longitudinally spaced glue spots 26 may also be used to secure the tab portion 20 to the front ply 11 along the upper edges as viewed in FIG. 4. The body portion 19 is also removably secured to the front ply 11 via a series of glue spots 27, e.g. located along the lower edges of the plies 11, 13. As shown in FIG. 4, the line of weakening 15 in the back ply 12 is located above the plane of the line of weakening 21 defining the removable tab portion 20 in the intermediate ply 13.

The insert plies 14 are located between the body portion 19 of the intermediate ply 13 and the front ply 11 above the glue spots 27 as viewed. In addition, each insert ply 14 is of a size smaller than the body portion 19 in order to fit within the pocket defined between the intermediate and back plies 13, 12.

Referring to FIGS. 1 and 2, the continuous mailer assembly 28 is constructed to provide a series of individual mailers 10. To this end, the assembly 28 includes three continuous webs of paper 29, 30, 31 which are disposed in overlying relation. Each of these webs 29, 30, 31 has a removable strip 32 with control line holes 33 therein along each of two opposite marginal edges. In addition, each web 29, 30, 31 has a longitudinal line of weakening 34 adjacent each marginal edge in order to define a removable stub 35 as well as a plurality of transverse lines of weakening 36 to divide the webs 29, 30, 31 into a series of individual mailers 10. The individual stubs 35 of each web 29, 30, 31 is secured to an adjacent stub 35, for example via a line of glue (not shown), for coincident removal.

In use, the continuous mailer 28 is processed in various types of automated equipment so as to impart various information at least on the face of each mailer 10. Thereafter, the strips 32 containing the control line holes 33 are stripped from the assembly 28. Next, the individual mailers 10 are separated from each along the lines of weakening 36 and mailed in usual manner.

Upon receipt of a mailer 10, the recipient or addressee removes the stubs 35 from each side of the mailer 10 and slowly peels back the top ply 11 as indicated in FIG. 3. During this time, the tab portion 20 of the intermediate ply 13 is simultaneously removed with the front ply 11 due to the securement of the tab portion 20 to the front ply 11 via the line of glue, 24. In this respect, the glue spots 18 permit the tab portion 20 to release from the back ply 12 while the glue spots 27 permit the front ply 11 to release from the body portion 19 of the intermediate 13. The insert plies 14 can then be processed in suitable manner. At this time, the body portion 19 of the intermediate ply 13 and the back ply 12 form a return mail envelope with an open pocket which is ready to receive an insert ply 14.

As shown in FIG. 5, one or more insert plies 14 may be inserted into the pocket of the return mail envelope. Thereafter, the flap 16 of the back ply 12 is folded over along the line of weakening 15 and sealed against the front face of the body portion 19 by activation of the adhesive blocks 17. The closed return mail envelope 37 (FIG. 6) can then be processed in the usual manner for mailing.

The invention thus provides a peel back mailer which can be readily constructed and manipulated in order to provide a readily accessable return mail envelope. Since the tab portion of the intermediate ply is removed simultaneously with the front ply, there is no need to perform subsequent operations in order to obtain a return mail envelope.

It is to be noted that the removable tab portion may be secured to the back ply. In this case, the body portion of the intermediate ply is permanently secured to the back of the front ply in order to provide the return mail envelope.

Figure 7:
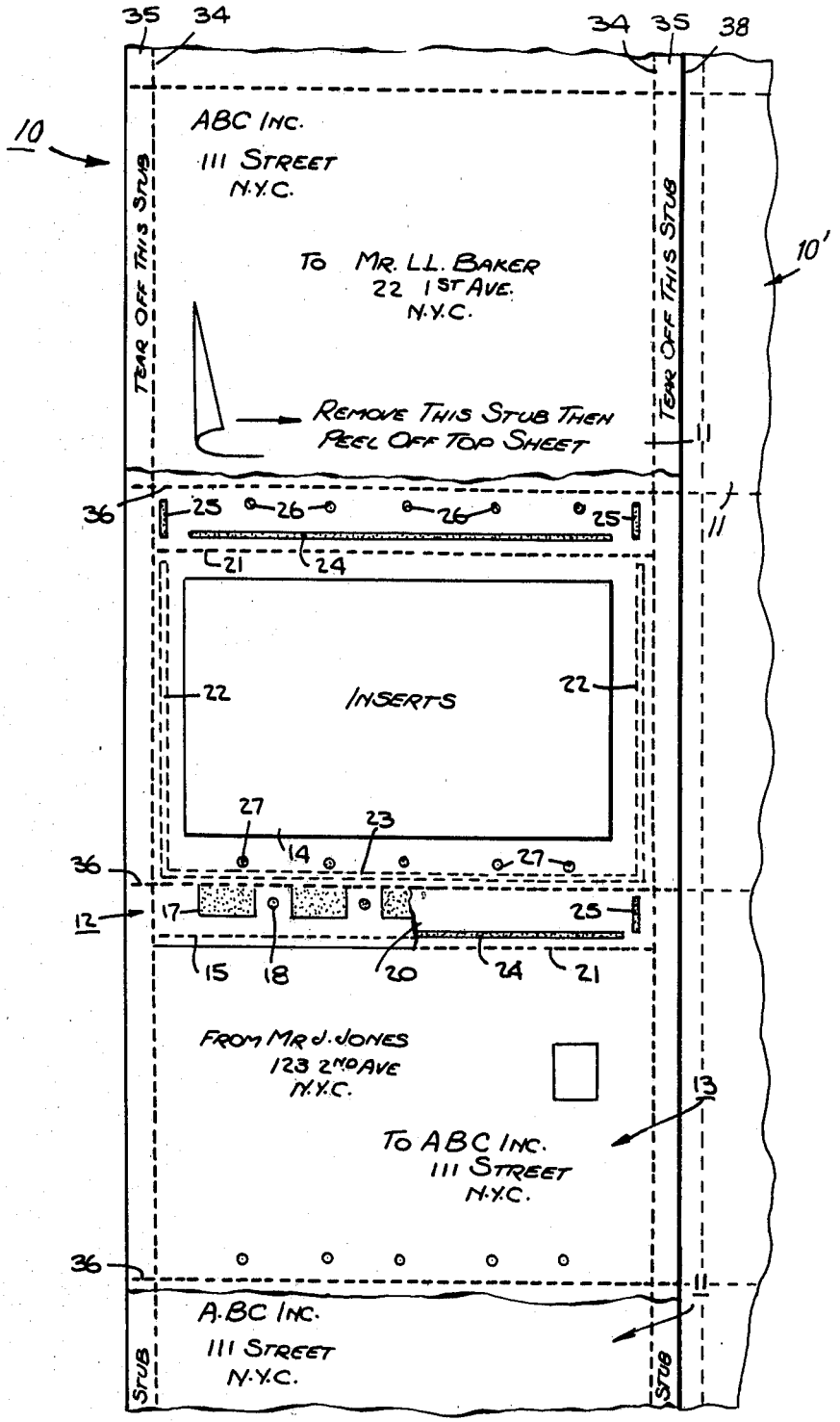
FIG. 7 illustrates a mailer assembly having two series of individual mailers in accordance with the invention.

As shown in FIG. 7, wherein like reference characters indicate like parts as above, the continuous mailer assembly may also have a longitudinal line of 38 down the middle in order to form two series of individual mailers 10,10' in a side-by-side relationship.

What is claimed is:

1. A mailer comprising a front ply for receiving information thereon;

a back ply including a foldable flap portion along one edge having adhesive means thereon facing said front ply;

an intermediate ply between said front ply and said back ply, said intermediate ply including a body portion, a tab portion and a line of weakening between said tab portion and said body portion, said body portion being secured to said back ply to define a pocket with an opening along said flap portion, said tab portion being secured to said front ply for removal therewith; and means releaseably securing said front ply to said body portion of said intermediate ply.

2. A mailer as set forth in claim 1 which further comprises at least one insert ply between said body portion of said intermediate ply and said front ply.

3. A mailer as set forth in claim 2 wherein said insert ply is of a size smaller than said body portion to fit within said pocket.

4. A mailer as set forth in claim 1 wherein said means releaseably securing said front ply to said body portion includes a plurality of fugitive glue spots between said body portion and said front ply.

5. A mailer as set forth in claim 4 which further comprises a plurality of glue spots between said tab portion and said flap portion for releaseably securing said tab portion to said flap portion of said back ply.

6. A mailer as set forth in claim 1 wherein each of said plies has a removable stub along each of two opposite edges, each said stub being secured to an adjacent stub for coincident removal therewith.

7. A mailer comprising a first ply;

a second ply including a flap portion along one edge having adhesive means thereon facing said first ply;

at least one of said plies having areas for receiving information thereon;

an intermediate ply between said first ply and second ply, said intermediate ply including a body portion a tab portion and a line of weakening between said tab portion and said body portion, said body portion being secured to said second ply to define a pocket therewith and said tab portion being secured to said first ply for removal therewith; and means releaseably securing said first ply to said body portion of said intermediate ply.

8. A mailer as set forth in claim 7 which further comprises a pair of longitudinal glue lines and a transverse glue line securing said body portion to said second ply.

9. A mailer as set forth in claim 8 which further comprises a pair of longitudinal glue lines and a transverse glue line securing said tab portion to said first ply.

10. A continuous mailer assembly comprising three continuous webs disposed in overlying relation, each of said webs having a removable strip with control line holes therein along each of two opposite marginal edges, a longitudinal line of weakening adjacent each said marginal edge to define a removable stub adjacent a removal strip and a plurality of transverse lines of weakening to divide said webs into a series of individual mailers; and means securing said stubs of each web to an adjacent stub for coincident removal;

each said mailer including a first ply in one of said webs, a second ply in a second of said webs including a flap portion along one transverse edge having adhesive means thereon facing said first ply and an intermediate ply in a third of said webs including a body portion and a tab portion removably secured to said body portion, said body portion being of equal transverse width to said first ply and said second ply and being secured to said second ply to define a pocket therewith and said tab portion being secured to said first ply for removal therewith.

11. A continuous mailer assembly as set forth in claim 10 which further comprises means releaseably securing each said first ply to said body portion of an adjacent intermediate ply.

12. A continuous mailer assembly as set forth in claim 10 wherein each web has a longitudinal line of weakening to divide said webs into two series of individual mailers disposed in side-by-side relation.

13. A continuous mailer assembly as set forth in claim 10 wherein each mailer includes at least one insert ply between said body portion and said first ply.

* * * * *